US008375959B2

(12) United States Patent
Dittrich et al.

(10) Patent No.: US 8,375,959 B2
(45) **Date of Patent: *Feb. 19, 2013**

(54) SMOKING ARTICLES AND SMOKABLE FILLER MATERIALS THEREFOR

(75) Inventors: David John Dittrich, Southampton (GB); Joseph Peter Sutton, Southampton (GB); Steven Coburn, Southampton (GB); James N Figlar, Clemmons, NC (US)

(73) Assignee: British American Tobacco (Investments) Limited, London (GB)

( * ) Notice: Subject to any disclaimer, the term of this patent is extended or adjusted under 35 U.S.C. 154(b) by 1139 days.

This patent is subject to a terminal disclaimer.

(21) Appl. No.: 10/512,712

(22) PCT Filed: Apr. 2, 2003

(86) PCT No.: PCT/GB03/01446

§ 371 (c)(1),
(2), (4) Date: Jul. 5, 2005

(87) PCT Pub. No.: WO03/092416

PCT Pub. Date: Nov. 13, 2003

(65) Prior Publication Data

US 2006/0130862 A1 Jun. 22, 2006

(30) Foreign Application Priority Data

Apr. 27, 2002 (GB) ..... 0209690.7

(51) Int. Cl.
*A24D 1/00* (2006.01)

(52) U.S. Cl. ..... 131/364; 131/331; 131/334; 131/341; 131/342; 131/344; 131/360; 131/352; 131/359

(58) Field of Classification Search ..... 131/331, 131/334, 341, 342, 344, 360, 364, 352, 359; 439/39

See application file for complete search history.

(56) References Cited

U.S. PATENT DOCUMENTS

| | | | | |
|---|---|---|---|---|
| 4,033,361 | A | 7/1977 | Horsewell et al. | |
| 4,453,553 | A * | 6/1984 | Cohn | 131/365 |
| 4,506,684 | A | 3/1985 | Keritsis | |
| 5,019,122 | A * | 5/1991 | Clearman et al. | 131/194 |
| 5,101,839 | A * | 4/1992 | Jakob et al. | 131/352 |
| 5,129,408 | A * | 7/1992 | Jakob et al. | 131/352 |
| 5,263,500 | A * | 11/1993 | Baldwin et al. | 131/365 |
| 6,311,696 | B1 | 11/2001 | Dittrich et al. | |
| 2005/0034739 | A1 * | 2/2005 | Dittrich et al. | 131/364 |

FOREIGN PATENT DOCUMENTS

| | | |
|---|---|---|
| EP | 0419975 A2 | 4/1991 |
| JP | 3180165 | 8/1991 |
| JP | 5292936 | 11/1993 |
| RU | 2045209 | 10/1995 |
| WO | 9732490 A1 | 9/1997 |
| WO | 0141590 A1 | 6/2001 |

* cited by examiner

*Primary Examiner* — Katarzyna Wyrozebski Lee
*Assistant Examiner* — Daniel Lee
(74) *Attorney, Agent, or Firm* — Middleton Reutlinger; Charles I. Sherman

(57) ABSTRACT

The invention relates to a smoking article incorporating a smoking material comprising three main components, namely a non-combustible inorganic filler, an alginic binder and aerosol generating means. The smoking material is combined with tobacco material, which may be treated with additional humectant, to provide a smoking article that has an aerosol transfer efficiency ratio of greater than 4.0.

64 Claims, 2 Drawing Sheets

SMOKING ARTICLES AND SMOKABLE FILLER MATERIALS THEREFOR

CROSS REFERENCE TO PRIOR APPLICATION

Figure 1:
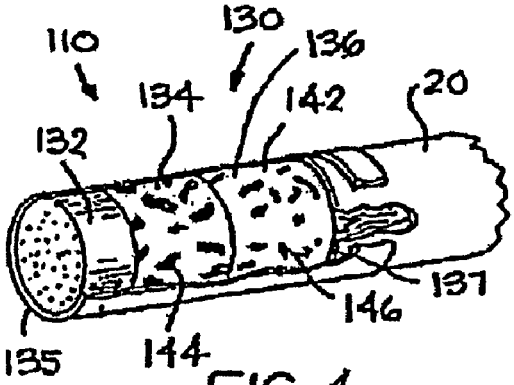

This application is a national stage filing (35 U.S.C. 371) of PCT/GB03/01446, filed on Apr. 2, 2003, which claims priority to and benefit of Great Britain Patent Application No. 0209690.7, filed on Apr. 27, 2002, currently pending.

This invention relates to smokable filler materials, which may be tobacco substitute materials, and smoking articles incorporating such materials.

It has been an object over many years to provide a smokable filler material that has a reduced amount of biological material therein, in order to reduce the potential health problems that appear to be related to the burning of such biological material, i.e. tobacco. To this end there is a large body of prior art relating to tobacco substitute materials or alternative smoking material. A problem with such alternative materials is that, with decreased amounts of combustible material in the smoking material, the combustion characteristics of the alternative materials can be difficult to control. Certain well-known combustion modifiers, e.g. burn additives, such as alkali metal salt of organic acids, sodium or potassium acetate, for example, or burn retardants, e.g. calcium or magnesium chloride, are then required to be added to the tobacco substitute or the alternative material in order to control the burn rate.

U.S. Pat. No. 4,109,664, International Patent Application, Publication No. WO 96/07336 and European Patent, Publication No. 0 419 975 describe smoking materials using inorganic filler materials (sometimes agglomerated, as in EP 0 419 975), binder and aerosol generating means comprising aerosol forming means. In none of these documents is any mention made of the aerosol former transfer efficiency of such materials compared with conventional cut tobacco, when utilised as the smokable filler in a smoking article. Indeed, the delivery of an increased amount of aerosol former to dilute the mainstream smoke is not contemplated in these documents. For example, the amount of glycerol in the Examples of U.S. Pat. No. 4,109,664 is 4% or less. In addition, in none of these documents is any mention made of the particle size of the inorganic filler material, nor of the advantageous effect on the static burn rate and/or ash characteristics of a smoking article comprising a smoking material incorporating such inorganic filler material. Furthermore, the sheet material of U.S. Pat. No. 4,109,664 exhibits poor processability characteristics, i.e. brittleness, during sheet formation.

One aspect of the invention is the provision of a smoking material which, in a smoking article incorporating such smoking material, has an aerosol former transfer efficiency that is greater than smoking material comprising conventional cut tobacco treated with similar amounts of aerosol former. Advantageously the aerosol former transfer efficiency is more than 40% higher than a blend of smoking material comprising solely the inventive smoking material compared with a blend comprising solely conventional cut tobacco.

In addition, the smoking material of the invention may advantageously incorporate non-combustible inorganic filler material, the mean particle size of which material has an advantageous effect on the burning characteristics of the smoking material.

It is an object of the invention to provide a smoking article containing a proportion of smoking material according to the invention, which smoking article has reduced mainstream smoke component yields compared with comparable delivery conventional smoking articles.

Another object of the invention is to provide a smoking article comprising a rod of smokable material comprising smoking material according to the invention and a tobacco smoke filter element capable of significantly reducing selected components of mainstream smoke, such as for example carbonyl compounds or hydrogen cyanide, the combination providing an enhanced reduction of some mainstream smoke components.

It is a further object to provide a smoking article having decreased tobacco specific nitrosamines.

It is also an object of the invention to provide a smoking material that has positive effects on one or more of the taste, smoke flavour or ash characteristics of a smoking article incorporating that material.

It is a further object to provide a method of controlling the delivery on a per puff basis of a smoking article incorporating the novel smoking material.

It is a yet further object to provide a method of controlling the static burn rate of a smoking material having a predetermined formulation.

The present invention provides a smoking material comprising a non-combustible inorganic filler material, an alginic binder and aerosol generating means.

Advantageously the smoking material of the invention comprises as the main components thereof, non-combustible inorganic filler, binder and aerosol generating means. These three components together preferably comprise at least 85% by weight of the smoking material, preferably greater than 90%, and even more preferably total about 94% or more by weight of the smoking material. The three components may even be 100% of the smoking material.

The remaining components are preferably one or more of colourant, fibre, such as wood pulp, or flavourant, for example. Other minor component materials will be known to the skilled man. The smoking material is therefore a very simple sheet in terms of its constituents.

As used herein, the term 'smoking material' means any material which can be used in a smoking article. It does not necessarily mean that the material itself will necessarily sustain combustion. The smoking material is usually produced as a sheet, then cut. The smoking material may then be blended with other materials to produce a smokable filler material.

The present invention further provides a smoking article comprising a wrapped rod of a smokable filler material, the smokable filler material consisting of a blend which incorporates smoking material comprising a non-combustible inorganic filler, an alginic binder and aerosol generating means, the smoking article having an aerosol transfer efficiency ratio of greater than 4.0.

As used herein, the aerosol transfer efficiency is measured as the percentage aerosol in the smoke divided by the percentage aerosol in the smokable filler material.

Preferably the aerosol transfer efficiency is greater than 5, and more preferably greater than 6.

The smokable filler material may comprise a blend consisting of not more than 75% by weight of the smoking material according to the invention.

Preferably the inorganic filler material is present in the range of 60-90%, and is more preferably greater than 70%. Advantageously the inorganic filler material is present at about 74% by weight of the final sheet material, but may be present at higher levels, for example, 80%, 85% or 90% by weight of the final sheet material.

The non-combustible filler advantageously comprises a proportion of material having a mean particle size in the range of 500 μm to 75 μm.

Preferably the mean particle size of the inorganic filler is in the range of 400 μm-100 μm, and is more than 125 μm, and preferably more than 150 μm. Advantageously the mean particle size is at or about 170 μm, and may be in the range of 170 μm-200 μm. This particle size is in contrast to that conventionally used for food grade inorganic filler materials in alternative tobacco products, namely a particle size of about 2-3 μm. The range of particle size seen for each inorganic filler individually may be from 1 μm-1 mm (1000 μm). The inorganic filler material may be ground, milled or precipitated to the desired particle size.

Advantageously the inorganic filler material is one or more of perlite, alumina, diatomaceous earth, calcium carbonate (chalk), vermiculite, magnesium oxide, magnesium sulphate, zinc oxide, calcium sulphate (gypsum); ferric oxide, pumice, titanium dioxide, calcium aluminate or other insoluble aluminates, or other inorganic filler materials. The density range of the materials is suitably in the range of 0.1-5.7 g/cm$^3$. Advantageously, the inorganic filler material has a density that is less than 3 g/cm$^3$, and preferably less than 2.5 g/cm$^3$, more preferably less than 2.0 g/cm$^3$ and even more preferably less than 1.5 g/cm$^3$. An inorganic filler having a density of less than 1 g/cm$^3$ is desirable. A lower density inorganic filler reduces the density of the product, thus improving the ash characteristics.

If a combination of inorganic filler materials is used, one or more of the fillers may suitably be of a small particle size and another may be of a larger particle size, the proportions of each filler being suitable to achieve the desired mean particle size. The static burn rate required in the finished smoking article may be achieved using an appropriate blend of tobacco and smoking material in the smokable filler material.

Preferably the inorganic filler material is not in agglomerated form. The inorganic filler material should require little pre-treatment, other than perhaps size gradation, before use.

Preferably the binder is present in the range of about 5-13%, more preferably less than 10% and even more preferably less than 8%, by weight of the final filler material. Advantageously the binder is about 7.5% by weight or less of the final sheet material.

Advantageously, if the binder is a mixture of alginate and non-alginate binders, then preferably the binder is comprised of at least 50% alginate, preferably at least 60% alginate and even more preferably at least 70% alginate. The amount of combined binder required may suitably decrease when a non-alginate binder is utilised. The amount of alginate in a binder combination advantageously increases as the amount of combined binder decreases. Suitable alginic binders include soluble alginates, such as ammonium alginate, sodium alginate, sodium calcium alginate, calcium ammonium alginate, potassium alginate, magnesium alginate, triethanol-amine alginate and propylene glycol alginate. Other organic binders such as cellulosic binders, gums or gels can also be used in combination with alginic binders. Suitable cellulosic binders include cellulose and cellulose derivatives, such as sodium carboxymethylcellulose, methyl cellulose, hydroxypropyl cellulose, hydroxyethyl cellulose or cellulose ethers. Suitable gums include gum arabic, gum ghatti, gum tragacanth, Karaya, locust bean, acacia, guar, quince seed or xanthan gums. Suitable gels include agar, agarose, carrageenans, furoidan and furcellaran. Starches can also be used as organic binders. Other suitable gums can be selected by reference to handbooks, such as Industrial Gums, E. Whistler (Academic Press).

Much preferred as the major proportion of the binder are alginic binders. Alginates are preferred in the invention for their neutral taste character upon combustion.

Preferably the aerosol generating means is. present in the range of 5-20%, more preferably is less than 15%, is even more preferably greater than 7% and even more preferably is greater than 10%. Preferably the aerosol generating means is less than 13%. Most preferably the aerosol generating means is between 11% and 13%, and may advantageously be about 11.25% or 12.5%, by weight of the final sheet material. Suitably the amount of aerosol generating means is selected in combination with the amount of tobacco material to be present in the blend comprising the smokable filler material of a smoking article. For example, in a blend comprising a high proportion of sheet material with a low proportion of tobacco material, the sheet material may require a lower loading level of aerosol generating means therein. Alternatively in a blend comprising a low proportion of sheet material with a high proportion of tobacco material, the sheet material may require a higher loading level of aerosol generating means therein.

Suitable aerosol generating means include aerosol forming means selected from polyhydric alcohols, such as glycerol, propylene glycol and triethylene glycol; esters, such as triethyl citrate or triacetin, high boiling point hydrocarbons, or non-polyols, such as glycols, sorbitol or lactic acid, for example. A combination of aerosol generating means may be used. An additional function of the aerosol generating means is the plasticising of the sheet material. Suitable additional plasticisers include water.

The sheet material may suitably be aerated. The cast slurry thereby forms a sheet material with a cellular structure.

Advantageously the aerosol generating means or a proportion of the aerosol generating means may be encapsulated, preferably micro-encapsulated, or stabilized in some other way. In such cases the amount of aerosol generating means may be higher than the range given.

Advantageously the smoking material comprises a colourant to darken the material and/or a flavourant to impart a particular flavour. Suitable flavouring or colourant materials include cocoa, liquorice, caramel, chocolate or toffee, for example. Finely ground, granulated or homogenised tobacco may also be used. Industry approved food colourants may also be used, such as E150a (caramel), E151 (brilliant black BN), E153 (vegetable carbon) or E155 (brown HT). Suitable flavourants include menthol and vanillin, for example. Other casing materials may also be suitable. In the alternative, the presence of vermiculite or other inorganic filler materials may give a darker colour to the smoking material.

Preferably the colourant is present from 0-10% and may be as much as 5-7% by weight of the final smoking material. Advantageously the colourant is less than 7%, preferably less than 6% and more preferably less than 5% of the final smoking material. Much preferred is use of colourant at less than 4%, less than 3% and less than 2%. Cocoa may suitably be present in a range of 0-5% and liquorice may be present in a range of 0-4%, by weight of the final smoking material. When the colourant is cocoa or liquorice, for example, the minimum amount of cocoa to obtain the desired sheet colour is about 3% and for liquorice is about 2%, by weight of the final smoking material. Similarly, caramel may suitably be present in a range of 0-5%, preferably less than about 2% by weight of the final smoking material, and more preferably about 1.5%. Other suitable colourants include molasses, malt extract, coffee extract, tea resinoids, St. John's Bread, prune extract or tobacco extract. Mixtures of colourants may also be used.

Flavourants may also be added to alter the taste and flavour characteristics of the smoking material.

Advantageously, if a food dye is utilised in the alternative it is present at 0.5% by weight or less of the final smoking material. The colourant may alternatively be dusted into the sheet after sheet manufacture.

Fibres, such as cellulose fibres, for example wood pulp, flax, hemp or bast could be added to provide the sheet material with one or more of a higher strength, lower density or higher fill value. Fibres, if added, may be present in the range of 0.5-10%, preferably less than 5% and even more preferably less than about 3% by weight of the final sheet material. Advantageously there is no fibrous material present in the sheet material, cellulosic or otherwise.

Advantageously the smoking material is a non-tobacco containing sheet.

It shall be understood that at high levels of sheet material inclusion in the blend, e.g. at greater than 75% by weight of the blend, the combustibility of the blend is poor. This may be overcome by, for example, incorporating low levels of up to 5-10% granular carbon in the smoking material. The carbon is preferably not an agglomerated carbonaceous material, i.e. the carbon is not pre-treated by mixing with another material to produce an agglomerate.

Preferably the smoking material is blended with tobacco material to provide smokable filler material. Preferably the tobacco material components in the blend are high quality lamina grades. Advantageously the majority of the tobacco material is cut tobacco. The tobacco material may comprise between 20-100% expanded tobacco of a high order expansion process, such as DIET for example. The filling power of such material is typically in the range of 6-9 cc/g (see GB1484536 or U.S. Pat. No. 4,340,073 for example).

Preferably the blend comprises <30% of other blend components apart from lamina, the other blend components being stein cut rolled stem(CRS), water treated stem (WTS) or steam treated stem (STS) or reconstituted tobacco. Preferably the other components comprise <20%, more preferably <10% and even more preferably <5% of the final weight of the tobacco material.

Suitably a smoking article according to the invention comprises tobacco material being treated with aerosol generating means. The tobacco material may be treated with aerosol generating means, but this is not essential for all blends of tobacco material and sheet material. The amount of aerosol generating means added to the tobacco is in the range of 2-6% by weight of the tobacco. The total amount of aerosol generating means in the blend of tobacco material and sheet material after processing is advantageously in the range of 4-12% by weight of the smokable material, preferably less than 10% and preferably more than 5%.

The tobacco material may additionally comprise casing material, if the blend is a US blend, the casing being a normal casing on the Burley portion of the blend, with or without a light casing on the remainder of the blend.

The tobacco material may be tobacco treated in accordance with the process described in U.S. Pat. Nos. 5,803,081, 6,135,121, 6,338,348 or 6,202,649 (which are incorporated herein by reference) and having lowered tobacco specific nitrosamines (TSNA). Smoking articles according to the invention incorporating such tobacco may have an even lower TSNA content than current commercial products incorporating such tobacco. Smoking articles incorporating a proportion of this tobacco have the added effect of even further reduced tobacco specific nitrosamine levels. Tobacco specific nitrosamines include N-nitrosonornicotine (NNN), N-nitrosoanatabine (NAT), N-nitrosoanabasine (NAB) and 4-(N-nitrosomethylamino)-1-(3-pyridyl)-1-butanone (NNK).

A further tobacco material useful in the invention is the enzymatically treated tobacco described in International Patent Application Publication No. WO00/02464 or U.S. Pat. Nos. 5,311,886 and 5,560,097, which are incorporated herein by reference. The latter two patents describe the use of an enzyme (protease) with or without a surfactant to remove protein from tobacco. The International Application describes the use of laccase instead of polyvinylpolypyrrolidone (PVPP) in order to remove polyphenols from the extract obtained from water extraction.

The inclusion levels of smoking material according to the invention and tobacco material are advantageously in the range of 25:75 (smoking material:tobacco)-75:25, and is preferably in the range of 50:50-60:40 and is advantageously about 60:40. The ratio may also be 50:50 or 50:45, depending on the smoke component dilutions required. However, in order to achieve smoke component reductions that are less dramatic the inclusion level of smoking material according to the invention and tobacco material may be in the range of 10:90-25:75. Ratios having a 5% incremental rise or decrease in either smoking material or tobacco are included herein. We have found that the aerosol transfer efficiency even at these levels is likely to be improved over merely applying the aerosol former to cut tobacco.

The product density of the mixed tobacco material and sheet material may be as high as 300-360 mg/cm$^3$, and may be in the range of 320-350 mg/cm$^3$. Advantageously the amounts of tobacco material and smoking material sheet are selected to give a product density of <300 mg/cm$^3$. Preferably the product density of the mixed tobacco and sheet material is in the range of a conventional product, i.e. about 220-240 mg/cm$^3$.

A range of deliveries is obtainable using the present invention. Ventilation may advantageously be used in the smoking article according to the invention in order to reduce delivery to <9 mg NFDPM. The delivery may be in the range of 2-6mg NFDPM, 3, 4 or 5 mg for example. This delivery includes an amount attributable to the aerosol former. Alternatively, or in addition thereto, the blend of the smokable filler may be altered to increase the amount of smoking material according to the invention, in order to reduce the smoke component delivery. The degree of ventilation may suitably be more than 30%, and is advantageously more than 40%, and may be about 50% or more. Preferably the tipping paper is pre-perforated.

The wrapper enwrapping the smoking article may comprise a burn additive, such as sodium and/or potassium citrate, for example. Other suitable burn additives, such as sodium or potassium salts, such as acetate and tartrate; mono-ammonium phosphate, and di-sodium hydrogen phosphate, for example, will be known to the skilled man. Advantageously the burn additive is present in the range of 0.5-2.5% by weight of the wrapper. The wrapper may also have a basis weight in the range of 20-40 g/m$^2$.

The smoking article may also have a slightly reduced circumference, advantageously in the range of 22-25 mm. A further reduced circumference may also be utilised, for example less than 22 mm.

The present invention further provides a smoking article comprising a proportion of smoking material according to the invention and further comprising a filter element, the filter element being operable to selectively reduce some mainstream smoke components of the smoke. In particular, the volatile and semi-volatile components of the mainstream smoke are reduced.

Advantageously the carbonyl compounds are significantly reduced compared to a conventional smoking article with the same particulate matter delivery.

Preferably the filter element contains particulate material, such as granular carbon, which may suitably be activated carbon. The activated carbon may be any one of the carbons described below in relation to the general absorbent of the Trionic filter described below. Preferably the activated carbon is activated coconut carbon. The filter containing particulate. material may be a dual filter comprising, for example, a cellulose acetate mouth section and a dalmatian rod at the tobacco end of the filter. A paper section may also form part of a multiple filter. Alternatively, the filter may be the filter manufactured in accordance with the structural design of the filter known as the Active Patch filter (manufactured by Filtrona International) as described in UK Patent Specification No. 2249936. In a yet further alternative, the filter element may be cavity filter comprising two end sections with a central cavity containing granular material.

The filter element may alternatively be a selective reduction filter known as the 'Trionic Filter' described in co-pending U.S. Provisional Patent Application Ser. Nos. 60/309,388 and 60/309,435 both filed on 1 Aug. 2001 (see FIGS. 1-3 hereof). The filter shown in FIG. 1 comprises a triple filter (130), a first upstream filter section (136) being located adjacent the tobacco rod (20) and being a selective adsorbent material, a second central filter section (134) being a general selective adsorbent material and a third downstream or mouth end located filter section (132) being a conventional fibrous section usually, of cellulose acetate for example. The three sections are interconnected by an overwrapping plugwrap (135). Such an arrangement gives a synergistic reduction in predetermined smoke constituents. In the alternative, the positions of the general selective adsorbent material section (134) and the selective adsorbent material section (136) may be reversed as shown in FIG. 2.

The selective adsorbent material is preferably selected from a group of surface functional resins, each resin consisting of an essentially inert carrier having a sufficient surface area to adsorb specific smoke constituents. The selective adsorbent is preferably an ion-exchange resin, such as Duolite A7 (available from Rohm and Haas, 5000 Richmond St, Philadelphia, Pa. 19137, USA) or a material having similar functional groups and binding affinities. Duolite A7 has a phenol-formaldehyde resin matrix and is surface-functionalised with primary and secondary amine groups, thereby enhancing the resin's specificity towards the aldeydes and hydrogen cyanide found in tobacco smoke.

Advantageously the selective adsorbent has a sufficient surface area to ensure that the surface functional sites are easily accessible with minimal resistance to diffusion. For example, a resin having a surface area of greater than about 35 $m^2/g$ can adsorb the smoke constituents provided the resin packing is not so high that the smoke stream is impeded as it passes through the filter. In addition, materials with a greater surface area demonstrate less noticeable performance decline if part of the surface is covered with plasticiser, as might occur when the adsorbent is dispersed in the filter plug.

Advantageously the general adsorbent is selected from a group of relatively high surface area materials capable of adsorbing smoke constituents without a high degree of specificity. Suitable general adsorbents can be selected from the group consisting of activated charcoal, activated coconut carbon, activated coal-based carbon or charcoal, zeolite, silica gel, meerschaum, aluminium oxide (activated or not), carbonaceous resin or combinations thereof. An example of a suitable coal-based charcoal is one made from semi-anthracite coal with a density about 50% greater than coconut-based charcoal (available from Calgen Carbon, Pittsburgh, Pa., WA). An example of a suitable carbonaceous resin is one derived from the pyrolysis of sulphonated styrene-divinyl benzene, such as Ambersorb 572 or Ambersorb 563 (available from Rohm and Haas). To enhance the efficiency of the general adsorbent metal oxides or other metal based complexes may optionally be included in or impregnated on the general adsorbent section.

Figure 2:
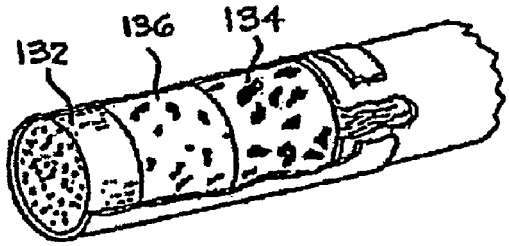
Figure 3:
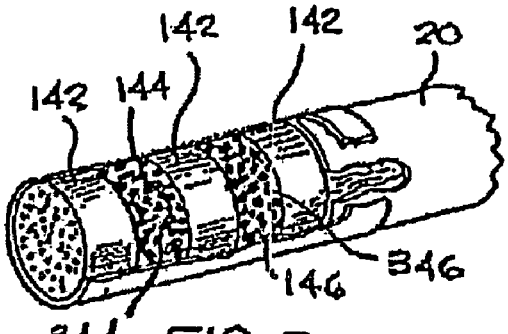

The general adsorbent and the selective adsorbent may be dispersed throughout a fibrous filter plug material, i.e. as a dalmatian filter (as shown in FIGS. 1 and 2), or may be packed within the fibrous filter plug material as a close-packed bed or thin layer section of adsorbent material, i.e. in a cavity section between two or three adjacent fibrous filter plugs (142) or in a cavity or pocket defined within a fibrous filter plug (as shown in FIG. 3). Such beds or thin layer sections (144,146) may also be inter-digitated with dalmatian sections for various different filtration effects.

The loading level of each of the adsorbent materials is in the range of 10-80 mg, preferably 20-60 mg, and is most preferably at least 40 mg of each adsorbent in each section depending on the filtration effects required of each component to be filtered. The total loading level of both adsorbents in the filter is in the range of 60-110 mg.

The mouth end located filter plug may be made from a variety of materials, for example, cellulose acetate tow, cellulose, paper, cotton, polypropylene web, polypropylene tow, polyester web, polyester tow or combinations thereof.

In addition, the pressure drop and/or mechanical filtration efficiency of the filter plug sections can be selected to achieve the desired smoking mechanics and filtration characteristics as maybe required with the specific product design desired.

Advantageously the combination of smokable filler material and filter element achieves an enhanced reduction in a number of mainstream smoke components, in particular carbonyl smoke components, such as formaldehyde, acetaldehyde, acetone, acrolein, propionaldehyde, crotonaldehyde, methyl ethyl ketone and butyraldehyde; phenols, such as phenol, o-cresol, m-cresol, p-cresol, catechol, resorcinol and hydroquinone; aromatic amines, such as 1-aminonapthalene, 2-aminonapthalene, 3-aminonapthalene and 4-aminonapthalene. Hydrogen cyanide is also suitably reduced.

The percentage reduction, when normalised with respect to nicotine free dry particulate matter (NFDPM), for many of the above mentioned compounds is 15% or more, preferably 20% or more, even more preferably 25% or more and for some compounds may be as much as 30% or more, 35% or more, and even 40% or more. Reductions of over 60% are obtainable for certain blends containing a proportion of tobacco and a proportion of the smoking material according to the invention.

A further filter construction that may be useful in the present invention is that described in our co-pending International Patent Application No. PCT/GB02/005603. The filter described therein comprises a filter plug (16) of homogeneous filtration material, a plug wrap (18) overwrapping the filter plug (16), circumferentially spaced grooves extending longitudinally of the filter plug (16), and a ventilating tipping paper interconnecting the filter element (14) to a tobacco rod (12), a number of grooves (20) being open on the side of the tobacco rod (12) and extending continuously only over a part of the length of the filter element (14), and hence not up to the mouth end of the filter element (14), which grooves (20) are axially aligned with respect to the filter axis, in to which axially extending grooves (20) ventilating air enters via overlying ventilating tipping paper, and any mouth end extending groove not being ventilated.

This grooved arrangement provides for ventilating air to enter grooves extending towards the tobacco end and then be re-directed towards the mouth end. The result is a decrease in the CO/tar ratio. In combination with particulate additives that selectively reduce vapour phases a significant reduction in vapour phase constituents can be achieved.

In addition, it has been observed that the ignition propensity of smoking articles incorporating smoking material according to the invention is considerably reduced. All the samples tested in accordance with the NIST standard test method (described below) for ignition propensity extinguished when left on Whatman filter paper, or duck fabric compared with control cigarettes which continued to burn.

The present invention further provides a method of controlling the static burn rate of a smoking article, wherein the smoking article comprises a rod of smokable filler material enwrapped in a wrapper, said smokable filler material incorporating a proportion of a smoking material comprising a non-combustible inorganic filler material, an alginic binder and aerosol generating means, said inorganic filler material comprising a proportion of material having a mean particle size in the range of 500 μm-20 μm, the particle size of the inorganic filler material being selected to provide the desired static burn rate, and/or an a mount of smoking material being selected in conjunction with an amount of tobacco material in a blend of smokable filler material to provide the desired static burn rate.

Applicant has additionally found that with careful selection of the particle size of the inorganic filler material, for a given formulation the static burn rate of the smoking material of the present invention can be altered without the need to alter the formulation. This represents a significant new tool to the product developer and cigarette designer. In addition, the smoke taste and flavour characteristics and/or the physical characteristics of a smoking article incorporating the smoking material according to the invention are largely controlled by the particle size selection of the inorganic filler.

Preferably the static burn rate of a smoking article comprising sheet material according to the invention is within the range of 3 mm/min to 8 mm/min. More preferably the static burn rate is in the range of 4-7.5 mm/min. Most preferably the static burn rate is in the range of 4-6 mm/min.

The smoking article may be wrapped with two cigarette papers, one being heavier than the other, the heavier one usually being the outer paper.

The wrapper of the smoking article may alternatively or in addition be a non-paper wrapper, such as the wrappers described in International Patent Applications, Publication Nos. WO 96/07336 and WO 01/41590. Such wrappers assist in the reduction of sidestream smoke components, but still provide a smoking article which has burning and ashing characteristics similar to conventional products, i.e. the wrappers allow the smoking article to burn down and ash in a similar way to conventional products. The wrapper may comprise particulate ceramic filler of predefined shape, a binder, optionally a burn additive and optionally an ash improver, said particulate ceramic filler being present in the range of 50-95% by weight of the dry materials in the slurry producing the wrapper. Advantageously the ceramic filler has a particle size in the range of 2-90 μm, more preferably 2-75 μm and even more preferably 25-70 μm. Preferably the mean particle size is greater than 30 μm, more preferably greater than 35 μm and even more preferably greater than 40 μm. A mean particle size of about 50 μm appears to be highly advantageous.

Preferably the ceramic filler has a regular or irregular, non-platelet particle shape. Advantageously, the ceramic filler is an insoluble or low solubility metal oxide or metal salt. The ceramic filler is preferably a thermally stable metal oxide or metal salt. The ceramic filler may be one or more of a lumina, silica, an a lumino-silicate, silicon carbide, stabilised or unstabilised zirconium oxide, zircon, garnet, feldspar, or other materials known to the skilled man and having the necessary particle size or other suitable ceramic materials having been milled to the necessary size or shape.

Preferably the ceramic filler is present at greater than 40% by weight of the dry materials in the slurry producing the wrapper, and is more preferably present in the range of 50-95%, more preferably 70-90%, and even more preferably 70-87.5%.

Advantageously the ceramic filler is not an activated filler, and hence have a low surface area, although activated ceramic fillers do work in the present invention.

Preferably the binder is an organic binder selected from one or more of an alginate, such as calcium alginate, propylene glycol alginate, a gum, a cellulose (modified or natural), a pectin or pectinaceous binder, starch, or the Group I or II metal salts of these binders, such as sodium carboxymethylcellulose or sodium alginate.

In addition or alternatively, the binder may advantageously be an inorganic binder capable of cementing the particles of ceramic filler together. The inorganic binder is preferably an activated inorganic material. The inorganic binder may be one or more of activated alumina, aluminium silicate, magnesium silicate or an inert clay.

Preferably the inorganic binder has a particle size in the range of 2-90 μm, more preferably in the range of 2-50 μm and is even more preferably in the range of 2-15 μm. The inorganic binder is suitably hydrophobic.

Preferably the binder is present at greater than 2% by weight of the dry materials in the slurry producing the wrapper, and is preferably present in the range of 3-30%, is more preferably <20% and even more preferably <10% by weight of the dry materials in the slurry. Most preferably the binder is in the range of 3-10%. The amount of ceramic filler and binder selected will depend on the binding properties of the binder selected.

The burn additive is usually present in the wrapper at a weight which is greater than that seen on paper wrappers. Preferably the burn additive is present in the range of 1-15% by weight of the dry materials in the slurry used to produce the wrapper and is more preferably <10% and even more preferably <5%. The burn additive is most preferably in the range of 2-5%. Preferably the burn additive is a burn promoter. Suitable burn additives may be selected from one or more of salts of Group I or II metals such as acetates, citrates and other burn promoters known to the skilled man.

The ash improver is present to provide bridging means or packing improvement means between the ceramic filler particles. The invention has as an aim the provision of a wrapper that does burn down and can ash like a conventional smoking article. The components of the wrapper, and in particular the ceramic filler and ash improver, have a particle size and/or shape such that their combination provides the necessary strength in the wrapper before combustion but loses such strength during combustion in order to provide acceptable ashing of the combusted products.

The inorganic ash improver suitably has a platelet morphology and is blended with the ceramic filler in order to control the permeability, ashing strength, colour and burning properties. The ash improver is optional but is advantageously present in the wrapper in the range of 0-5%. Materials that have the appropriate platelet morphology compared to the more rounded shape of the ceramic filler, include one or more of mica, chalk, perlite, clays, such as, for example, vermiculite; kaolinites and talcs. These materials might also be suitable as the ceramic filler provided they can be milled to the appropriate size and shape.

Alternatively the ash improver may be a material with a very small particle size such that particles thereof bridge the voids between the larger ceramic filler particles.

The wrapper advantageously is permeable and preferably has a permeability less than 200 Coresta Units (CU) and is preferably in the range of 2-100 CU. More preferably the permeability of the wrapper is in the range of 5-50 CU and may be less than 10 CU.

The wrapper should have a density of 0.5-3.0 g/cm$^3$, preferably 0.8-1.2 g/cm$^3$ and more preferably of the order of about 1.0 g/cm$^3$ and should have a tensile strength capable of withstanding manual handling. The wrapper advantageously is capable of sustaining a thickness in the range of 0.2-0.6 mm.

Figure 4:
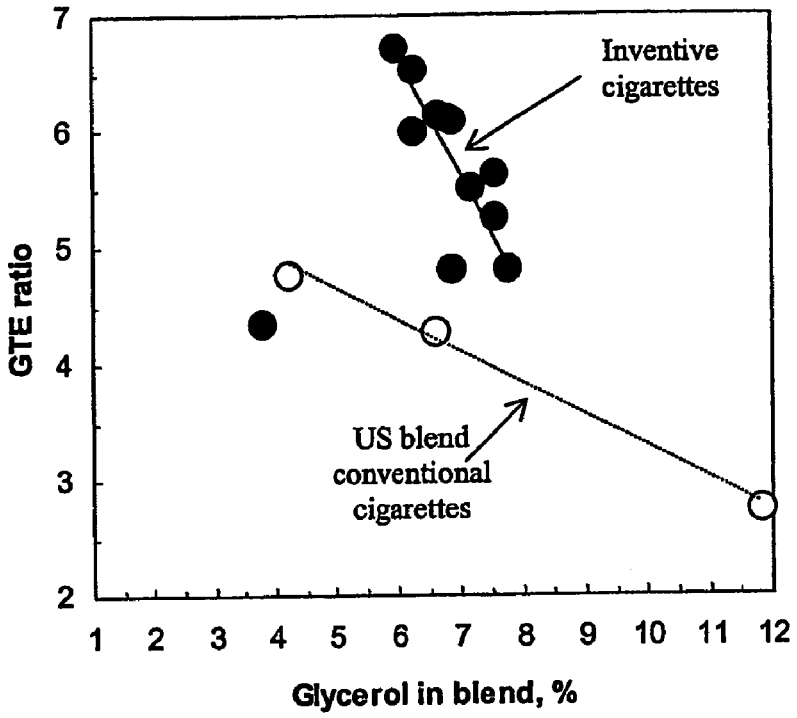
Figure 5:
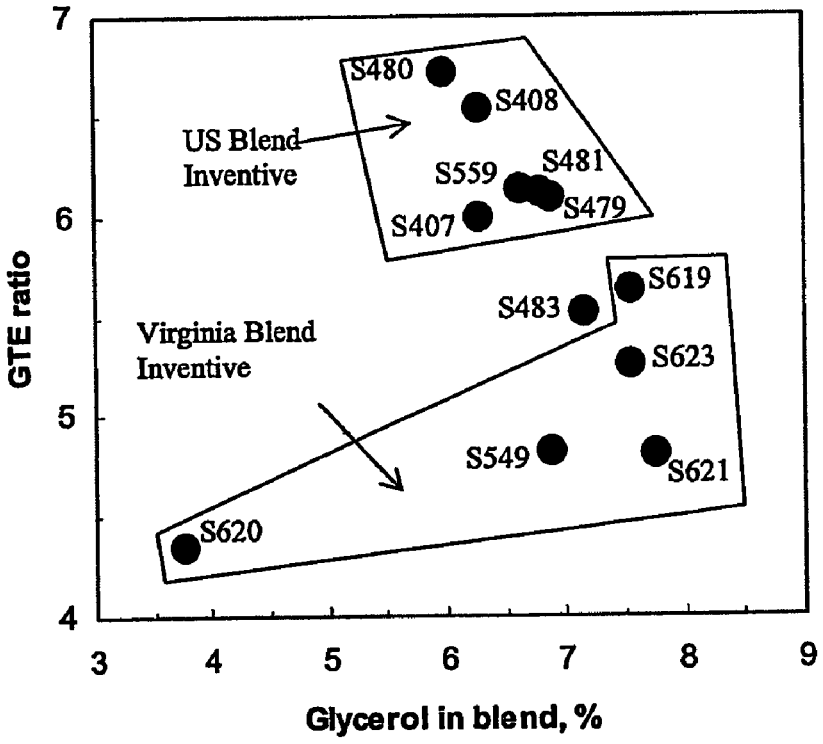

In order that the invention can easily be understood and readily carried into effect, reference will now be made to the following diagrammatic drawings, in which:

FIGS. 1, 2 and 3 show filter elements useful in a smoking article according to the invention, and FIGS. 4 and 5 show in graphical form the results of Table 4.

EXAMPLE 1

Smoking materials according to the invention were made by weighing up a 3 kg dry formulation consisting of 74% chalk (inorganic filler material), 12% glycerol (aerosol generating means), 8% sodium alginate (binder), 4% cocoa and 2% liquorice (colourants/flavourants). 8 liters of water was gradually added to a dry mixture of chalk, glycerol, cocoa and liquorice. The alginate is added to the mixture with the water. The mixture was mixed using a Silverson mixer until the slurry reached an appropriate viscosity (30,000 cps). The slurry was then cast to produce a wet sheet of 1 mm thickness and dried using a heated drum caster. The material was shredded at 37 cpi using a shredder, blended with cut tobacco and made into cigarettes. Cigarettes of 84 mm length comprising a 27 mm filter were wrapped with a paper of 50 CU. Table 1 details the composition and physical characteristics of the chalk used. A control cigarette comprising a blend of 100% tobacco was used, being an all lamina mix consisting of flue-cured, Burley and Oriental grades, 40% of the total blend being DIET expanded tobacco. Each set of test cigarettes comprised a blend of 40% tobacco and 60% smoking material sheet according to the invention. The cigarettes were smoked under ISO standard machine smoking conditions according to which a 35 cm$^3$ puff of two seconds duration is taken every minute.

TABLE 1

| | S479 | S480 | S481 | S482 | S483 | S484 |
|---|---|---|---|---|---|---|
| Density (mg/cm$^3$) | 324 | 315 | 321 | 308 | 312 | 184 |
| Chalk type | 100% V100 | 100% V100 | 100% V60 | 50% pptd 50% V100 | 100% pptd | — |
| Mean Particle Size of chalk | 250μ | 250μ | 100–80μ | — | 2μ | — |
| Tobacco inclusion level in blend (%) | 40 | 40 | 40 | 40 | 40 | 100 |
| Puff Number | 7.4 | 7.1 | 7.3 | 5.2 | 5.1 | 5.0 |
| Static Burn Rate (mm/min) | 4.72 | 5.09 | 5.19 | 6.95 | 7.07 | 6.53 |

It can be seen from Table 1 that as particle size decreases, the static burn rate of the smoking article increases. Optimising the particle size and the mixtures of different particle sizes will provide a significant new tool for the cigarette designer.

EXAMPLE 2

Further samples of the smoking material of the invention were produced. The samples utilised different particle sizes of chalk. After sheet preparation and cutting the smoking material of the invention was mixed with a blend of cut tobacco material. The same tobacco blend as in S568 was mixed at a 100% level as a control blend. The materials were used to produce cigarettes of 24.7 mm circumference and 83.5 mm length with 21 mm cellulose acetate filters. The paper permeability was 50 CU for each cigarette. All the cigarettes were conditioned at 22° C.±1° C. and 60% RH (±2%) for a minimum of 48 hours. Their static burn ratio was measured using a Filtrona free burn rate machine (FBR100). The data is given below.

TABLE 2

| | Chalk | Sheet inclusion level in blend | Density | Static Burn Rate (after conditioning) | |
|---|---|---|---|---|---|
| Code | particle size | with tobacco | (mg/cm$^3$) | Secs/40 mm | mm/min |
| S483 | Precipitated chalk | 60% | 312 | 282.8 | 7.07 |
| S563 | V40 | 60% | 334 | 479.7 | 5.00 |
| S564 | V60 | 60% | 320 | 471.2 | 5.09 |
| S565 | V100 | 60% | 320 | 491.2 | 4.89 |
| S567 | V100 | 10% | 214 | 414.3 | 5.79 |
| S568 | Tobacco Blend | 0% | 191 | 375.1 | 6.40 |

The data of Table 2 shows that the tobacco blend was the fastest burning material. As the particle size of the chalk increases the static burn rate decreases. In addition, as the amount of smoking material in the blend decreases the static burn rate of the overall blend increases. This data supports that in Example 1.

EXAMPLE 3

A further sheet material was made up by drum casting the formulation consisting of 78.5% chalk, 12.5% glycerol, 7.5% binder and 1.5% caramel (E150a). The mean particle size of the chalk was about 170 μm. This sheet material exhibited acceptable smoulder characteristics and physical characteristics, such as ashing. The static burn rate was ?? mm/min.

EXAMPLE 4

A further sheet material was made up by drum casting the formulation consisting of 75.25% chalk, 11.25% glycerol, 7.5% binder, 4% cocoa and 2% liquorice. The mean particle size of the chalk was about 170 μm. This sheet material also exhibited acceptable smoulder characteristics and physical characteristics, such as ashing. The static burn rate was 4.72 mm/min.

EXAMPLE 5

Three sets of cigarettes were produced. S295 had a rod length of 83.5 mm, a circumference of 24.7 mm, a filter length of 20 mm and a density of 199 mg/cm$^3$. S384 and S382 had a rod length of 84 mm, a circumference of 24.7 mm, a filter length of 20 mm and densities of 229 mg/cm$^3$ and 340 mg/cm$^3$ respectively. One set comprised 100% tobacco (as per the tobacco of Example 1), the second set comprised sheet material utilising 100% V100 chalk and the third set comprised sheet material utilising 100% precipitated chalk. The formulation of the sheet material was the same as Example 4.

TABLE 3

| | | S295 (100% tobacco) | S384 (100% V100 chalk) | S382 (100% precipitated chalk) |
|---|---|---|---|---|
| Heat of combustion in the blend (Kcal/cig) | | 1.8 | 1.7 | 1.5 |
| Peripheral combustion (° C.) | Smouldering between puffs | 767.8 | 762.0 | 765.6 |
| | Puffing | 866.9 | 820.8 | 883.3 |
| Inner pyrolysis (° C.) | Smouldering between puffs | 731.2 | 690.4 | 653.4 |
| | Puffing | 754.6 | 709.5 | 731.0 |

From Table 3 it is clear that, surprisingly, smoking articles according to the invention, despite having a smokable filler material comprising 60% sheet material according to the invention, maintain the same or similar combustion mechanisms as cigarettes comprising 100% tobacco.

EXAMPLE 6

In order to investigate the aerosol transfer efficiency (ATE) of the sheet material of the invention when mixed with tobacco compared to cut tobacco treated with humectant at varying levels a range of samples was prepared.

A group of US blended cigarettes comprising 100% tobacco was produced (cigarette code BW007). The densities of samples BW-007-2, BW-007-3 and BW-007-4 were 264, 263 and 264 mg/cm$^3$ respectively. The amount of glycerol on the blend ranged from about 4% to about 12%. A range of samples were also prepared with 40% of a similar tobacco blend mixed with 60% smoking material according to the invention (samples S480, S408, S481, S479, S559, S483 and S407). The total amount of glycerol on the blend of tobacco and sheet material ranged from about 3.5% to about 8%. No glycerol was added to the tobacco portion of these particular blends. The density of these samples were 315, 207, 321, 324, 320, 312 and 227 mg/cm$^3$ respectively. A further set of samples was prepared with flue-cured tobacco in the same 40:60 ratio with smoking material according to the invention (samples S619, S623, S621, S549 and S620). The density of These samples were 333, 299, 320, 328 and 255 mg/cm$^3$ respectively. The resulting data obtained is shown in Table 4 below.

TABLE 4

| Cigarette Type | Cigarette code/ Sheet ID | % Glycerol in blend | NFDPM (mg/cig) | Glycerol in smoke (mg/cig) | % Glycerol in smoke | GTE ratio |
|---|---|---|---|---|---|---|
| Glycerol on tobacco | BW007-2 | 4.21 | 9.16 | 1.84 | 20.09 | 4.77 |
| | BW007-3 | 6.61 | 9.58 | 2.71 | 28.29 | 4.28 |
| | BW007-4 | 11.83 | 10.15 | 3.29 | 32.41 | 2.74 |
| New sheet cigarettes | S407 | 6.28 | 6.66 | 2.51 | 37.69 | 6.00 |
| | S408 | 6.28 | 5.87 | 2.41 | 41.06 | 6.54 |
| | S479 | 6.88 | 12.15 | 5.09 | 41.89 | 6.09 |
| | S480 | 5.98 | 11.13 | 4.47 | 40.16 | 6.72 |
| | S481 | 6.78 | 11.13 | 4.62 | 41.51 | 6.12 |
| | S483 | 7.16 | 8.91 | 3.52 | 39.51 | 5.52 |
| | S549 | 6.88 | 7.24 | 2.40 | 33.15 | 4.82 |
| | S559 | 6.63 | 6.80 | 2.77 | 40.74 | 6.14 |
| | S619 | 7.54 | 13.41 | 5.69 | 42.43 | 5.63 |
| | S620 | 3.77 | 13.43 | 2.20 | 16.38 | 4.35 |
| | S621 | 7.76 | 13.17 | 4.92 | 37.36 | 4.81 |
| | S623 | 7.54 | 12.06 | 4.77 | 39.55 | 5.25 |

From the Table it can be seen that the aerosol transfer efficiency, in this case glycerol transfer efficiency (GTE), decreases with increase in the blend glycerol for control 100% tobacco blends. In contrast, the GTE's of the inventive cigarettes are higher than those of the control 100% tobacco cigarettes, except for one (S620) which had a lower percentage glycerol in the blend to start with. For samples with similar loading levels of glycerol (S559 v. BW-007-3) it is possible to obtain a 43% increase in GTE for S559 over the tobacco control sample. A comparable GTE (4.35) can be obtained for a lower glycerol loading level (3.77%) in the blend of S620 compared with a GTE of 4.28 or 4.77 for glycerol loading levels on conventional 100% tobacco blends, indicating a greater efficiency of usage for glycerol using the invention.

The figures of Table 4 are shown graphically in FIGS. 4 and 5 of the drawings hereof.

EXAMPLE 7

Mainstream smoke measurements under standard ISO machine smoking conditions were carried out on one of the samples used in Example 6, namely S479. As mentioned above S479 is a US blended style product, so a control cigarette (S484) was used of 100% of the same tobacco blend used in S479, as well as comparison against a commercially available cigarette of the same or similar particulate matter delivery, namely Marlboro Lights. The ac in Table 5, as well as the normalised deliveries with respect to 1 mg of nicotine free dry particulate matter (NFDPM).

TABLE 5

| | MEASURED VALUE | | | | % | VALUE/NFDPM | | | | |
|---|---|---|---|---|---|---|---|---|---|---|
| ANALYTE | Tobacco (S484) | 60:40 sheet:tobacco (S479) | % Reduction | Marlboro Lights | Reduction v.Marlboro Lights | US blend (S484) | 60:40 Sheet:Tobacco (S479 | % Reduction | Marlboro Lights | % Reduction V M. Lights |
| NFDPM (mg/cig) | 4.9 | 5.1 | | 5.4 | 5.5 | | | | | |
| Glycerol (mg/cig) | 0.40 | 1.92 | | 0.55 | −249.1 | | | | | |
| NHFDPM | 4.50 | 3.18 | | 4.85 | 34.4 | | | | | |
| Nicotine (mg/cig) | 0.65 | 0.40 | | 0.48 | 16.7 | | | | | |
| Puff No. | 6.6 | 8.5 | | 7.3 | | | | | | |
| Ammonia (μg/cig) | 14.0 | 12.0 | 14.29 | 20.7 | 42.0 | 2.86 | 2.35 | 17.65 | 3.83 | 38.6 |
| Aromatic Amines (ng/cig) | | | | | | | | | | |
| 1-Aminonaphthalene | 14.1 | 8.9 | 36.88 | 13.4 | 33.5 | 2.88 | 1.75 | 39.35 | 2.48 | 29.4 |
| 2-Aminonaphthalene | 11.3 | 9.2 | 18.58 | 14.1 | 34.8 | 2.31 | 1.80 | 21.78 | 2.61 | 31.0 |
| 3-Aminobiphenyl | 2.3 | 2.3 | 0 | 2.6 | 11.5 | 0.47 | 0.45 | 3.92 | 0.48 | 6.3 |
| 4-Aminobiphyenyl | 1.9 | 1.9 | 0 | 2.1 | 9.5 | 0.39 | 0.37 | 3.92 | 0.39 | 5.1 |
| Benzo(a)Pyrene (μg/cig) | 5.3 | 3.9 | 26.42 | 6.6 | 40.9 | 1.08 | 0.77 | 29.30 | 1.22 | 36.9 |
| Carbonyls (μg/cig) | | | | | | | | | | |
| Formaldehyde | 9.5 | 7.9 | 16.84 | 25.0 | 68.4 | 1.94 | 1.55 | 20.10 | 4.63 | 66.5 |
| Acetaldehyde | 190.0 | 129.0 | 32.10 | 342.5 | 62.3 | 38.78 | 25.29 | 34.77 | 63.43 | 60.1 |
| Acetone | 110.8 | 74.1 | 33.12 | 184.6 | 59.8 | 22.61 | 14.53 | 35.75 | 34.19 | 48.7 |
| Acrolein | 16.8 | 12.7 | 24.40 | 34.6 | 63.2 | 3.43 | 2.49 | 27.37 | 6.41 | 61.2 |
| Propionaldehyde | 13.3 | 5.4 | 59.40 | 25.7 | 79.0 | 2.71 | 1.06 | 60.99 | 4.76 | 77.7 |
| Crotonaldehyde | 4.6 | 2.5 | 45.65 | 7.3 | 65.8 | 0.94 | 0.49 | 47.78 | 1.35 | 63.7 |
| Methyl Ethyl Ketone | 17.0 | 15.0 | 11.76 | 26.9 | 44.2 | 3.47 | 2.94 | 15.22 | 4.98 | 41.0 |
| Butyraldehyde | 9.4 | 2.5 | 73.40 | 16.8 | 85.1 | 1.92 | 0.49 | 74.45 | 3.11 | 84.2 |
| Carbon Monoxide (mg/cig) | 3.8 | 3.4 | 10.53 | | | 0.78 | 0.67 | 14.10 | | |
| Hydrogen Cyanide (μg/cig) | 33.4 | 16.1 | 51.80 | 57.7 | 72.1 | 6.82 | 3.16 | 53.69 | 10.69 | 70.4 |
| Nitrosamines (ng/cig) | | | | | | | | | | |
| NNN | 54 | 23 | 57.41 | 49 | 53.1 | 11.02 | 4.51 | 59.08 | 9.07 | 50.3 |
| NAT | 61 | 30 | 47.54 | 49 | 38.8 | 12.45 | 5.88 | 52.75 | 9.07 | 35.2 |
| NAB | 9 | 6 | 33.33 | 8 | 0.25 | 1.84 | 1.18 | 35.95 | 1.48 | 20.2 |
| NNK | 17 | 11 | 35.29 | 31 | 64.5 | 3.47 | 2.16 | 37.83 | 5.94 | 62.4 |
| Phenols (μg/cig) | | | | | | | | | | |
| Phenols | 15.43 | 3.53 | 77.12 | 9.29 | 62.0 | 3.15 | 0.69 | 78.02 | 1.72 | 59.9 |
| o-Cresol | 3.21 | 1.25 | 61.06 | 2.62 | 52.3 | 0.66 | 0.25 | 62.59 | 0.49 | 48.9 |
| m-Cresol | 2.51 | 0.99 | 60.59 | 2.23 | 55.6 | 0.51 | 0.19 | 62.10 | 0.41 | 53.7 |
| p-Cresol | 5.97 | 1.96 | 67.17 | 4.64 | 57.8 | 1.22 | 0.38 | 68.46 | 0.86 | 55.8 |
| Catechol | 37.83 | 16.07 | 57.52 | 37.95 | 57.7 | 7.72 | 3.15 | 59.19 | 7.03 | 55.2 |
| Resorcinol | 0.55 | 0.19 | 65.45 | 0.74 | 74.3 | 0.11 | 0.04 | 66.81 | 0.14 | 71.4 |
| Hydroquinone | 31.21 | 16.73 | 46.40 | 36.33 | 53.9 | 6.37 | 3.28 | 48.50 | 6.73 | 51.3 |
| Pyridine(μg/cig) | 3.84 | 2.20 | 42.71 | 3.36 | 34.5 | 0.78 | 0.43 | 44.96 | 0.62 | 30.6 |
| Quinoline (μg/cig) | 0.28 | 0.09 | 67.86 | 0.20 | 55.0 | 0.06 | 0.02 | 69.21 | 0.04 | 50.0 |
| Styrene (μg/cig) | 2.25 | 1.81 | 19.56 | 3.00 | 39.7 | 0.46 | 0.36 | 22.71 | 0.56 | 35.7 |

It can be seen that these are significant reductions in some aromatic amines and carbonyls, as well as significant reductions in tobacco specific nitrosamines and phenols. Some smoke components show reductions of more than 30%, with others showing reductions of over 60%, some times as high as 80%.

Clearly the invention provides a significant means to decrease some smoke components whilst providing an acceptable smoke taste and flavour.

EXAMPLE 8

Mainstream smoke measurements under standard ISO machine smoking conditions were also carried out on a flue-cured style product (J473), so a control cigarette (T431) was used of 100% of the same tobacco blend as used in J473. The control cigarette has the same flue-cured blend as is used in Example 10 below. The sheet of J473 comprised 75% chalk, 7.5% sodium alginate, 12.5% glycerol and 5% E150a caramel. A comparison against a commercially available cigarette of the same or similar particulate matter delivery, namely Silk Cut King Size (SCKS) was also made. The actual deliveries are given in Table 6, as well as the normalised deliveries with respect to 1 mg of nicotine free dry particulate matter (NFDPM).

TABLE 6

| | MEASURED VALUE | | | | | VALUE/NFDPM | | | | |
|---|---|---|---|---|---|---|---|---|---|---|
| ANALYTE | Flue cured tobacco (T431) | 60:40 sheet tobacco (J473) | % Reduction | Silk Cut King Size (SCKS) | % Reduction v.SCKS | Flue cured blend (T431) | 60:40 sheet tobacco (J473) | % Reduction | Silk Cut King Size (SCKS) | % Reduction V SCKS |
| NFDPM (mg/cig) | 6.7 | 4.7 | 29.85 | 5.0 | 6.00 | | | | | |
| Glycerol (mg/cig) | 0 | 2.1 | | | | | | | | |
| NHFDPM | 6.7 | 2.6 | 61.19 | 5 | 48.00 | | | | | |
| Nicotine (mg/cig) | 0.73 | 0.29 | 60.27 | 0.47 | 38.30 | | | | | |
| Puff No. | 7.4 | 10.1 | −36.49 | 8.3 | −21.69 | | | | | |
| Ammonia (μg/cig) | 10.9 | 7.3 | 33.03 | 10.9 | 33.03 | 1.63 | 1.55 | 4.91 | 2.18 | 28.75 |
| Aromatic Amines (ng/cig) | | | | | | | | | | |
| 1-Aminonaphthalene | 3.3 | 3.9 | −18.18 | 5.5 | 29.09 | 0.49 | 0.83 | −69.39 | 1.10 | 24.56 |
| 2-Aminonaphthalene | 3.5 | 2.4 | 31.43 | 3.6 | 33.33 | 0.52 | 0.51 | 1.92 | 0.72 | 29.08 |
| 3-Aminobiphenyl | 0.5 | 0.5 | 0.00 | 0.7 | 28.57 | 0.07 | 0.11 | −57.14 | 0.14 | 24.01 |
| 4-Aminobiphenyl | 0.6 | 0.6 | 0.00 | 0.8 | 25.00 | 0.09 | 0.13 | −44.44 | 0.16 | 20.21 |
| Benzo(a)Pyrene (μg/cig) | 7.7 | 4.8 | 37.66 | 7.7 | 37.66 | 1.15 | 1.02 | 11.30 | 1.54 | 33.68 |
| Carbonyls (μg/cig) | | | | | | | | | | |
| Formaldehyde | 27 | 15 | 44.44 | 12 | −25.00 | 4.03 | 3.19 | 20.84 | 2.40 | −32.98 |
| Acetaldehyde | 266 | 134 | 49.62 | 227 | 40.97 | 39.70 | 28.51 | 28.19 | 45.40 | 37.20 |
| Acetone | 148 | 78 | 47.30 | 131 | 40.46 | 22.09 | 16.60 | 24.85 | 26.20 | 36.66 |
| Acrolein | 36 | 24 | 33.33 | 24 | 0.00 | 5.37 | 5.11 | 4.84 | 4.80 | −6.38 |
| Propionaldehyde | 26 | 14 | 46.15 | 22 | 36.36 | 3.88 | 2.98 | 23.20 | 4.40 | 32.30 |
| Crotonaldehyde | 6 | 3 | 50.00 | 5 | 40.00 | 0.90 | 0.64 | 28.89 | 1.00 | 36.17 |
| Methyl Ethyl Ketone | 34 | 21 | 38.24 | 33 | 36.36 | 5.07 | 4.47 | 11.83 | 6.60 | 32.30 |
| Butyraldehyde | 16 | 7 | 56.25 | 14 | 50.00 | 2.39 | 1.49 | 37.66 | 2.80 | 46.81 |
| Carbon Monoxide (mg/cig) | 5.9 | 3.9 | 33.90 | 5 | 22.00 | 0.88 | 0.83 | 5.68 | 1.00 | 17.02 |
| Hydrogen Cyanide (μg/cig) | 52 | 12.5 | 75.96 | 34.9 | 64.18 | 7.76 | 2.66 | 65.72 | 6.98 | 61.90 |
| Nitrosamines (ng/cig) | | | | | | | | | | |
| NNN | 12 | 6 | 50.00 | 18 | 66.67 | 1.79 | 1.28 | 28.49 | 3.60 | 64.54 |
| NAT | 22 | 12 | 45.45 | 33 | 63.64 | 3.28 | 2.55 | 22.26 | 6.60 | 61.32 |
| NAB | — | nd | | | | | | | | |
| NNK | 21 | 7 | 66.67 | 20 | 65.00 | 3.13 | 1.49 | 52.40 | 4.00 | 62.77 |
| Phenols (μg/cig) | | | | | | | | | | |
| Phenols | 13.1 | 1.67 | 87.25 | 14.3 | 88.32 | 1.96 | 0.36 | 81.63 | 2.86 | 87.58 |
| o-Cresol | 2.94 | 0.45 | 84.69 | 4.07 | 88.94 | 0.44 | 0.10 | 77.27 | 0.81 | 88.24 |
| m-Cresol | 2.75 | 0.27 | 90.18 | 3.54 | 92.37 | 0.41 | 0.06 | 85.37 | 0.71 | 91.89 |
| p-Cresol | 5.77 | 0.68 | 88.21 | 6.71 | 89.87 | 0.86 | 0.14 | 83.72 | 1.34 | 89.22 |
| Catechol | 46.4 | 16.3 | 64.87 | 41 | 60.24 | 6.93 | 3.47 | 49.93 | 8.20 | 57.71 |
| Resorcinol | 1.27 | 0.55 | 56.69 | 1.08 | 49.07 | 0.19 | 0.12 | 36.84 | 0.22 | 45.82 |
| Hydroquinone | 36.2 | 12.2 | 66.30 | 36.6 | 66.67 | 5.40 | 2.60 | 51.85 | 13.26 | 80.42 |
| Pyridine (μg/cig) | 3.05 | 0.65 | 78.69 | 3.49 | 81.38 | 0.46 | 0.14 | 69.57 | 0.70 | 80.19 |
| Quinoline (μg/cig) | 0.48 | 0.04 | 91.67 | 0.67 | 94.03 | 0.07 | 0.01 | 85.71 | 0.13 | 93.65 |
| Styrene (μg/cig) | 4.79 | 2.16 | 54.91 | 4.19 | 48.45 | 0.71 | 0.46 | 35.21 | 0.84 | 45.16 |

It can be seen that these are significant reductions in some aromatic amines and carbonyls, as well as very significant reductions in tobacco specific nitrosamines and phenols. Some smoke components show reductions of more than 30%, with others showing reductions of over 60%, some times as high as 80% or 90%.

Clearly the invention provides a significant means to decrease some smoke components whilst providing an acceptable smoke taste and flavour.

EXAMPLE 9

Another feature of the invention is the additional reductions obtainable when the smoking material is blended with tobacco and subjected to selective filtration of volatile and semi-volatile smoke phases using selective reduction filter elements. In order to assess the effects that can be achieved the following filtered samples were evaluated. A standard mono-cellulose acetate sample and a dual acetate sample were prepared with the 60:40 US blended tobacco blend to provide controls for each filter variant next described.

A dual filter element comprising a cellulose acetate mouth section and a carbon dalmatian tobacco rod section (RS162) was produced, as was a carbon patch variant (Active Patch Filter) Table 7 details the physical parameters of the cigarettes. The actual deliveries of some components are given in Table 8, as well as the deliveries normalised with respect to 1 mg nicotine free dry particulate matter.

EXAMPLE 10

In order to evaluate the effect of the Trionic™ filter in conjunction with the smoking material of the invention in a tobacco blend of 60:40 respectively, the same 60:40 blend was used with a mono-cellulose acetate filter, a dual carbon filter and a Trionic™ filter. Control cigarettes included a mono-cellulose acetate filter with 100% conventional cut lamina Virginia tobacco and a commercially available cigarette of the same particulate matter delivery, namely Silk Cut Extra Mild.

Table 8 shows the hydrocarbon results for methane and total particulate matter (TPM) and Table 9 shows the reductions for certain carbonyl components of smoke. Each Table shows the percentage improved reduction obtained using a Trionic™ filter compared with the other filter elements or control samples. Significant reductions of methane per mg TPM can be seen, as well as total carbonyl reduction per mg NFDPM.

TABLE 9

| Analyte (Hydrocarbon) | T16 (Trionic) | T14(CA) | RS164 (Dual Carbon) | T31 (CA, 100% tobacco) | Silk Cut Extra Mild |
|---|---|---|---|---|---|
| CH4 (Methane mg/cig) | 1.22 | 1.55 | 1.39 | 2.55 | 1.26 |
| TPM (mg/cig) | 10.86 | 7.00 | 7.3 | 9.48 | 3.27 |
| CH4/TPM | 0.11 | 0.22 | 0.19 | 0.27 | 0.39 |

TABLE 7

| | Filter Element | Filter length (mm) | Rod length (mm) | Butt length (mm) | Tip vent (%) | Paper Perm (CU) | Filter PD (Bound-(mm WG) | Total blend Weight (tobacco & sheet) (mg) | Density (mg/cc) |
|---|---|---|---|---|---|---|---|---|---|
| RS161 | Mono CA Control | 27 | 56.6 | 35 | 50 | 45 | 92 | 844 | 317 |
| RS162 | Dual CA Control | 15 CA 12 CA | 56.8 | 35 | 50 | 43 | 100 | 848 | 320 |
| RS163 | Carbon Patch | 27 | 56.1 | 35 | 51 | 45 | 97 | 849 | 325 |
| RS165 | Carbon Dual | 15 CA 12 CA | 56.3 | 35 | 51 | 44 | 96 | 826 | 316 |

TABLE 8

| | RS161 | RS162 | RS163 | % Reduction | RS164 | % Reduction | Value/NFDPM | | | | | |
|---|---|---|---|---|---|---|---|---|---|---|---|---|
| Analyte (μg/cig) | Mono CA Control | Dual CA Control | Carbon Patch | against RS161 | Carbon Dual | against RS162 | RS161 | RS163 | % Reduction | RS162 | RS164 | % Reduction |
| Formaldehyde | 9.9 | 10.7 | 10.3 | — | 9.7 | 9.3 | 1.87 | 1.98 | — | 2.49 | 1.67 | 32.9 |
| Acetaldehyde | 166.5 | 199.3 | 168.6 | — | 126.4 | 36.6 | 31.41 | 32.42 | — | 46.34 | 21.79 | 52.0 |
| Acetone | 91.7 | 106.7 | 89.5 | 2.4 | 48.3 | 54.7 | 17.30 | 17.2 | 0.01 | 24.8 | 83.27 | — |
| Acrolein | 19.2 | 23.0 | 15.5 | 19.3 | 5.5 | 76.1 | 3.62 | 2.98 | 17.7 | 5.35 | — | — |
| Propionaldehyde | 14.4 | 14.1 | 10.0 | 30.5 | 4.4 | 68.7 | 2.72 | 1.92 | 29.4 | 3.28 | — | — |
| Crotonaldehyde | 3.3 | 4.7 | 3.6 | — | 0.6 | 87.2 | — | 0.69 | — | 1.09 | — | — |
| Methyl Ethyl Ketone | 17.8 | 20.0 | 14.5 | 18.5 | 4.7 | 76.5 | 3.36 | 2.79 | 16.9 | 4.65 | — | — |
| Butyraldehyde | 7.7 | 8.9 | 3.7 | 51.9 | 5.1 | 42.6 | 1.45 | — | — | 2.07 | — | — |
| Total (μg/cig) | 330.5 | 387.4 | 315.7 | 4.5 | 204.7 | 47.2 | 62.36 | 60.7 | 2.7 | 90.09 | 35.29 | 60.8 |
| NFDPM (mg/cig) | 5.3 | 4.3 | 5.2 | 1.8 | 5.8 | — | — | — | — | — | — | — |
| Total/NFDPM | 62.4 | 90.1 | 60.7 | 2.7 | 35.3 | 60.1 | 11.7 | 11.7 | 0 | 20.95 | 6.08 | 70.97 |

TABLE 9-continued

| Analyte (Hydrocarbon) | T16 (Trionic) | T14(CA) | RS164 (Dual Carbon) | T31 (CA, 100% tobacco) | Silk Cut Extra Mild |
|---|---|---|---|---|---|
| % Reduction for T16 compared to the other filters | | 50 | 42 | 59 | 72 |

TABLE 10

| Analyte (Carbonyls) (μg/cig) | T16 Trionic | S549 Mono CA | S630 CA, 100% tobacco | RS164 Carbon Dual |
|---|---|---|---|---|
| Fomaldehyde | 9.0 | 20.7 | 24.4 | 9.7 |
| Acetaldehyde | 112.9 | 223.5 | 247.7 | 126.4 |
| Acetone | 26.6 | 125.6 | 130.7 | 48.3 |
| Acrolein | 6.3 | 32.3 | 33.9 | 5.5 |
| Ropionaldehyde | 4.6 | 15.8 | 19.5 | 4.4 |
| Crobonaldehyde | 0.6 | 5.3 | 6.8 | 6.6 |
| Methyl Ethyl Ketone | 4.3 | 21.6 | 25.0 | 4.7 |
| Butyraldehyde | 3.6 | 8.1 | 12.8 | 5.1 |
| Total (μg/cig) | 167.9 | 452.9 | 500.8 | 204.7 |
| NFDPM (mg/cig) | 8.15 | 5.7 | 6.7 | 5.8 |
| Total/NFDPM | 20.6 | 79.5 | 74.7 | 35.3 |
| % Reduction for T16 compared to other filters. | — | 74 | 72 | 42 |

EXAMPLE 11

Ignition propensity tests were carried out in accordance with the testing procedure specified by the National Institute of Standards and Technology (NIST) using the methodology described by Ohlemiller, T. J; Villa, K. M, Braun. E., Eberhardt, K. R., Harris R. H., Lawson, J. R. and Gann, R. G. (1993) "Test methods for quantifying the propensity of Cigarettes to ignite soft furnishings" NIST Special Report 851, Gaithersburg Md., USA.

Tests were conducted on 10 layers of filter paper using 40 unventilated cigarettes (S558) comprising smoking material according to the invention All 40 samples self-extinguished. The S558 cigarettes had 27 mm cellulose acetate filters, 24.7 mm circumference, 83.5 total length, 50 CU paper and had a density of 320 mg/cm$^3$. The smoking material comprising 40% tobacco and 60% sheet material according to the invention. 16 cigarettes comprising the control US blend (code S484 referred to above) were similarly tested. All 16 cigarettes burnt to completion. 40 samples of S558 (inventive cigarette) were tested on three duck fabrics of different weights, namely #4, #6 and #10. S558 self extinguished on all 3 duck fabrics. All of the control samples (S484) did not ignite on the heaviest duck fabric (#10), but did ignite the two lighter duck fabrics.

The invention claimed is:

1. A smoking article in which the static burn rate can be altered without the need to alter the formulation of the smokable filler material comprising a wrapped rod of a smokable filler material, the smokable filler material consisting of a blend, which blend incorporates smoking material consisting of a noncombustible, non-agglomerated inorganic filler material, an alginic binder, and aerosol generating means in an amount less than 13% by weight of the smoking material, which three components together comprise greater than 90% by weight of the smoking material, and colourant at 0-7% by weight of the smoking material, and optionally granular carbon at 5-10% by weight of the smoking material, wherein the inorganic filler material has a mean particle size in the range of 500 μm to 75 μm, the particle size of the inorganic filler material being selected to provide the desired static burn rate, at least a proportion of the aerosol generating means being stabilized by being encapsulated or micro-encapsulated and wherein the smoking article has an aerosol transfer efficiency ratio of greater than 4.0.

2. A smoking article according to claim 1, wherein said three components of the smoking material together total about 94% or more by weight of the smoking material.

3. A smoking article according to claim 2, wherein said three components total 100% by weight of the smoking material.

4. A smoking article according to claim 1, wherein the inorganic filler material is present in the range of 60-90% by weight of the smoking material.

5. A smoking article according to claim 4 wherein the inorganic filler material is present at greater than 70% by weight of the smoking material.

6. A smoking article according to claim 5, wherein the inorganic filler material is present at about 74% by weight of the smoking material.

7. A smoking article according to claim 1, wherein the mean particle size of the inorganic filler is in the range of 400 μm-100 μm.

8. A smoking article according to claim 7, wherein the mean particle size of the inorganic filler material is more than 125 μm.

9. A smoking article according to claim 8, wherein the mean particle size is more than 150 μm.

10. A smoking article according to claim 9, wherein the mean particle size is at or about 170 μm.

11. A smoking article according to claim 1, wherein the inorganic filler material is selected from the group consisting of perlite, alumina, diatomaceous earth, calcium carbonate (chalk), vermiculite, magnesium oxide, magnesium sulphate, zinc oxide, calcium sulphate (gypsum), ferric oxide, pumice, titanium dioxide, calcium aluminate, insoluble aluminates, inorganic filler materials or combinations thereof.

12. A smoking article according to claim 11, wherein the density range of the inorganic filler materials is in the range of 0.1-5.7 g/cm$^3$.

13. A smoking article according to claim 12, wherein the inorganic filler material has a density that is less than 3 g/cm$^3$.

14. A smoking article according to claim 13, wherein the inorganic filler material has a density that is less than 2.5 g/cm$^3$.

15. A smoking article according to claim 14, wherein the inorganic filler has a density that is less than 2.0 g/cm$^3$.

16. A smoking article according to claim 15, wherein the inorganic filler has a density that is less than 1.5 g/cm$^3$.

17. A smoking article according to claim 1, wherein the binder is present in the range of about 5-13% by weight of the smoking material.

18. A smoking article according to claim 17, wherein the binder is less than 10% by weight of the smoking material.

19. A smoking article according to claim 18, wherein the binder is less than 8% by weight of the smoking material.

20. A smoking article according to claim 19, wherein the binder is about 7.5% by weight of the smoking material.

21. A smoking article according to claim 1, wherein the alginic binder is selected from the group consisting of soluble alginates, ammonium alginate, sodium alginate, sodium calcium alginate, calcium ammonium alginate, potassium alginate, magnesium alginate, triethanol-amine alginate, propylene glycol alginate or combinations thereof.

22. A smoking article according to claim 1, wherein the aerosol generating means is present at greater than 7% by weight of the smoking material.

23. A smoking article according to claim 22, wherein the aerosol generating means is greater than 10% by weight of the smoking material.

24. A smoking article according to claim 1, wherein the aerosol generating means comprises aerosol forming means selected from the group consisting of polyhydric alcohols, glycerol, propylene glycol, triethylene glycol, esters, triethyl citrate, triacetin, high boiling point hydrocarbons, non-polyols, glycols, sorbitol, lactic acid or combinations thereof.

25. A smoking article according to claim 1, wherein the smoking material comprises a colourant selected from the group consisting of cocoa, liquorice, caramel, chocolate, toffee or combinations thereof.

26. A smoking article according to claim 1 wherein said smokable filler material is blended with tobacco material.

27. A smoking article according to claim 26 wherein said tobacco material comprises an amount of aerosol generating means in the range of 2-6% by weight of tobacco material.

28. A smoking article according to claim 26, wherein the total amount of aerosol generating means in the blend of tobacco material and smoking material is in the range of 4-12% by weight of the smokable filler material.

29. A smoking article according to claim 26, wherein the inclusion levels in the blended smokable filler material and tobacco material, of smoking material and tobacco material are in the range of 25:75 to 75:25 (smoking material: tobacco).

30. A smoking article according to claim 1, wherein the wrapper of said wrapped rod comprises burn additive in the range of 0.5-2.5% by weight of the wrapper.

31. A smoking article according to claim 1, wherein said article further comprises a filter element operable to selectively reduce some volatile and semi-volatile components of mainstream smoke.

32. A smoking article according to claim 31, wherein carbonyl compounds are significantly reduced compared to a conventional smoking article with the same particulate matter delivery.

33. A smoking article according to claim 31, wherein said filter comprises a cellulose acetate mouth section and a dalmatian rod section containing a particulate absorbent or adsorbent material at the tobacco end of the filter.

34. A smoking article according to claim 31, wherein said filter element is a cavity filter comprising two end sections with a central cavity containing granular material.

35. A smoking article according to claim 31, wherein the filter element comprises a wrapper to which particulate absorbent or adsorbent material is adhered.

36. A smoking article according to claim 31, wherein said filter element comprises a triple filter, a first upstream filter section being located adjacent the smokable filler material rod and being a selective adsorbent material, a second central filter section being a general adsorbent material and a third downstream or mouth end located filter section being a conventional fibrous section.

37. A smoking article according to claim 31, wherein said filter element comprises a triple filter, a first upstream filter section being located adjacent the smokable filler material rod and being a general adsorbent material, a second central filter section being a selective adsorbent material and a third downstream or mouth end located filter section being a conventional fibrous section.

38. A smoking article according to claim 36, wherein the selective adsorbent material is a surface functional resin consisting of an essentially inert carrier having a sufficient surface area to adsorb specific smoke constituents.

39. A smoking article according to claim 38, wherein the resin is an ion-exchange resin.

40. A smoking article according to claim 39, wherein the resin has a phenol-formaldehyde resin matrix and is surface-functionalised with primary and secondary amine groups.

41. A smoking article according to claim 37, wherein the selective adsorbent has a surface area of greater than about 35 $m^2/g$.

42. A smoking article according to claim 36, wherein the general adsorbent is selected from a group of relatively high surface area materials capable of adsorbing smoke constituents without a high degree of specificity.

43. A smoking article according to claim 42, wherein the general adsorbent is selected from the group consisting of activated charcoal, activated coconut carbon, activated coal-based carbon or charcoal, zeolite, silica gel, meerschaum, aluminium oxide (activated or not), carbonaceous resin, or combinations thereof.

44. A smoking article according to claim 36, wherein the loading level of each of the adsorbent materials is in the range of 10-80 mg.

45. A smoking article according to claim 44, wherein the loading level is in the range of 20-60 mg.

46. A smoking article according to claim 36, wherein the mouth end located filter section is any one of cellulose acetate tow, cellulose, paper, cotton, polypropylene web, polypropylene tow, polyester web, polyester tow, or combinations thereof.

47. A smoking article according to claim 31, wherein said filter comprises a filter plug of homogeneous filtration material, a plug wrap overwrapping the filter plug, circumferentially spaced grooves extending longitudinally of the filter plug, and a ventilating tipping paper interconnecting the filter element to a tobacco rod, a number of grooves being open on the side of the tobacco rod and extending continuously only over a part of the length of the filter element, and hence not up to the mouth end of the filter element, which grooves are axially aligned with respect to the filter axis, in to which axially extending grooves ventilating air enters via overlying ventilating tipping paper, and any mouth end extending groove not being ventilated.

48. A method of controlling the static burn rate of a smoking article according to claim 1, said inorganic filler material comprising a proportion of material having a mean particle size in the range of 500 μm-20 μm, the mean particle size of the inorganic filler material being selected to provide the desired static burn rate.

49. A method according to claim 48, wherein the static burn rate is within the range of 3 mm/min to 8 mm/min.

50. A smoking article according to claim 1, wherein the wrapper of said smoking article comprises particulate ceramic filler of predefined shape, a binder, optionally a burn additive and optionally an ash improver, said particulate ceramic filler being present in the range of 50-95% by weight of the dry materials of the wrapper.

51. A smoking article according to claim 50, wherein the ceramic filler has a mean particle size in the range of 2-90 μm.

52. A smoking article according to claim 51, wherein the ceramic filler has a mean particle size of about 50 μm.

53. A smoking article according to claim 50, wherein the ceramic filler is one or more of alumina, silica, an aluminosilicate, silicon carbide, stabilised or un-stabilised zirconium oxide, zircon, garnet or feldspar.

54. A smoking article according to claim 50, wherein the binder is an organic binder selected from one or more of an alginate, such as calcium alginate, propylene glycol alginate, a gum, a cellulose (modified or natural), a pectin or pectinaceous binder, starch, or the Group I or II metal salts of these binders.

55. A smoking article according to claim 50, wherein the binder is an inorganic binder selected from one or more of activated alumina, aluminium silicate, magnesium silicate or an inert clay.

56. A smoking article according to claim 50, wherein the binder is present in the range of 3-30% by weight of the dry materials in the wrapper.

57. A smoking article according to claim 50, wherein burn additive is present in the wrapper in the range of 1-15% by weight of the dry materials of the wrapper.

58. A smoking article according to claim 37, wherein the selective adsorbent material is a surface functional resin consisting of an essentially inert carrier having a sufficient surface area to adsorb specific smoke constituents.

59. A smoking article according to claim 58, wherein the resin is an ion-exchange resin.

60. A smoking article according to claim 59, wherein the resin has a phenol-formaldehyde resin matrix and is surface-functionalized with primary and secondary amine groups.

61. A smoking article according to claim 37, wherein the general adsorbent is selected from a group of relatively high surface area materials capable of adsorbing smoke constituents without a high degree of specificity.

62. A smoking article according to claim 61, wherein the general adsorbent is selected from the group consisting of activated charcoal, activated coconut carbon, activated coal-based carbon or charcoal, zeolite, silica gel, meerschaum, aluminum oxide (activated or not), carbonaceous resin, or combinations thereof.

63. A smoking article according to claim 37, wherein the loading level of each of the adsorbent materials is in the range of 10-80 mg.

64. A smoking article according to claim 63, wherein the loading level is in the range of 20-60 mg.

* * * * *